United States Patent [19]

Plewright et al.

[11] Patent Number: 4,839,933

[45] Date of Patent: Jun. 20, 1989

[54] PATIENT TRANSFER AND CONVEYING VEHICLE

[76] Inventors: William B. Plewright; Kenneth O. Weir; Richard J. Patterson, all of C/-85 Napier Street, Cottesloe, Australia

[21] Appl. No.: 56,480

[22] PCT Filed: Aug. 13, 1986

[86] PCT No.: PCT/AU86/00240

§ 371 Date: Apr. 13, 1987

§ 102(e) Date: Apr. 13, 1987

[87] PCT Pub. No.: WO87/01030

PCT Pub. Date: Feb. 26, 1987

[30] Foreign Application Priority Data

Aug. 13, 1985 [AU] Australia ..... PH1921

[51] Int. Cl.[4] ..... A61G 7/08; A47C 21/08

[52] U.S. Cl. ..... 5/81 R; 5/81 B; 5/428; 5/430

[58] Field of Search ..... 5/81 R, 81 C, 425, 428–430

[56] References Cited

U.S. PATENT DOCUMENTS 2,857,604 10/1958 Shaw ..... 5/428

3,344,445 10/1967 Crawford ..... 5/81 B X 4,274,168 6/1981 Depowski ..... 5/81 B

FOREIGN PATENT DOCUMENTS 2068850 8/1981 United Kingdom ..... 5/81 B

*Primary Examiner*—Gary L. Smith

*Assistant Examiner*—Michael F. Trettel

*Attorney, Agent, or Firm*—Harness, Dickey & Pierce

[57] ABSTRACT

A patient transfer trolley for transferring patients from one location to another in hospitals and like establishments. The trolley comprises a wheeled frame (11) carrying a patient support surface (13) and a device (15) for aiding transfer of a patient between said patient support surface (13) and a further support surface such as a hospital bed or operating table. The handling device (15) comprises a body (41) having a transfer surface (43. The body is movable whereby it can assume first and second positions, and preferably also a third position. In the first position the transfer surface provides a bridge between said patient support surface and said further support surface. In the second position the body extends upwardly of the patient support surface to provide a safety barrier therfor. In the third position the body is stored so as not to obstruct access to the patient support surface (13).

11 Claims, 10 Drawing Sheets

PATIENT TRANSFER AND CONVEYING VEHICLE

BACKGROUND OF THE INVENTION

This invention relates to an aid to the handling of humans and animals (hereinafter referred to as "patients"), whether alive or deceased. In particular, the invention relates to a handling device for aiding the transfer of a patient from one support surface to another, as from a hospital bed or other supporting surface to a patient transfer trolley, and from a patient transfer trolley to an operating table, hospital bed or other supporting surface.

The transfer of patients to various locations in hospitals, mortuaries and like establishments presents difficulties. It is common practice for patients to be transferred on patient transfer trolleys which can be manually propelled from one location to another. Usually, a patient is manually lifted onto and from the trolley by several hospital attendants. In manually lifting the patient, the hospital attendants are exposed to risk of injury. In addition, the patient is also exposed to risk of injury when being manhandled.

The present invention seeks to provide a handling device for aiding the transfer of a patient from one support surface to another.

SUMMARY OF THE INVENTION

In one form the invention resides in a handling device for aiding patient transfer between two support surfaces when such surfaces are positioned adjacent one another, said handling device comprising a body having a transfer surface, the body being attached or attachable to an apparatus providing one of the support surfaces, the body being movable whereby it can assume first and second positions wherein in the first position the transfer surface bridges said support surfaces and wherein in the second position the body extends upwardly of said one support surface to provide a safety barrier therefor.

In another form the invention resides in a patient transfer trolley comprising a wheeled frame carrying a patient support surface and a device for aiding transfer of a patient between said patient support surface and a further support surface which in use is located adjacent said patient support surface, characterised in that the handling device comprises a body having a transfer surface, the body being movable whereby it can assume first and second positions, wherein in the first position the transfer surface provides a bridge between said patient support surface and said further support surface and wherein said second position the body extends upwardly of the patient support surface to provide a safety barrier therefor.

The patient transfer trolley may for example be a trolley intended exclusively for transferring patients on a wheeled bed capable of being used as a trolley (commonly referred to as a trolley bed).

Preferably, the body is capable of assuming a third position in which it is clear of the first and second positions so as to not obstruct access to the patient supporting surface. For preference, the third position is located substantially below the patient supporting surface.

Preferably, the body is mounted on track means having a vertical track section and an inclined track section extending downwardly and inwardly from the upper end of the vertical track section, wherein the body is received in and extends upwardly of the vertical track section when in the second position and wherein the body is received in the inclined track section when in the third position.

Preferably, at least part of the transfer surface is defined by a plurality of elongated rollers disposed longitudinally of the patient support surface.

Preferably, at least part of the patient support surface is defined by a plurality of further elongated rollers disposed longitudinally of the patient support surface.

BRIEF DESCRIPTION OF THE DRAWINGS

The invention will be better understood by reference to the following description of one specific embodiment thereof as applied to a patient transfer trolley as used in hospitals. The description will be made with reference to the accompanying drawings in which.

DETAILED DESCRIPTION OF THE PREFERRED EMBODIMENT OF THE INVENTION

Figure 1:
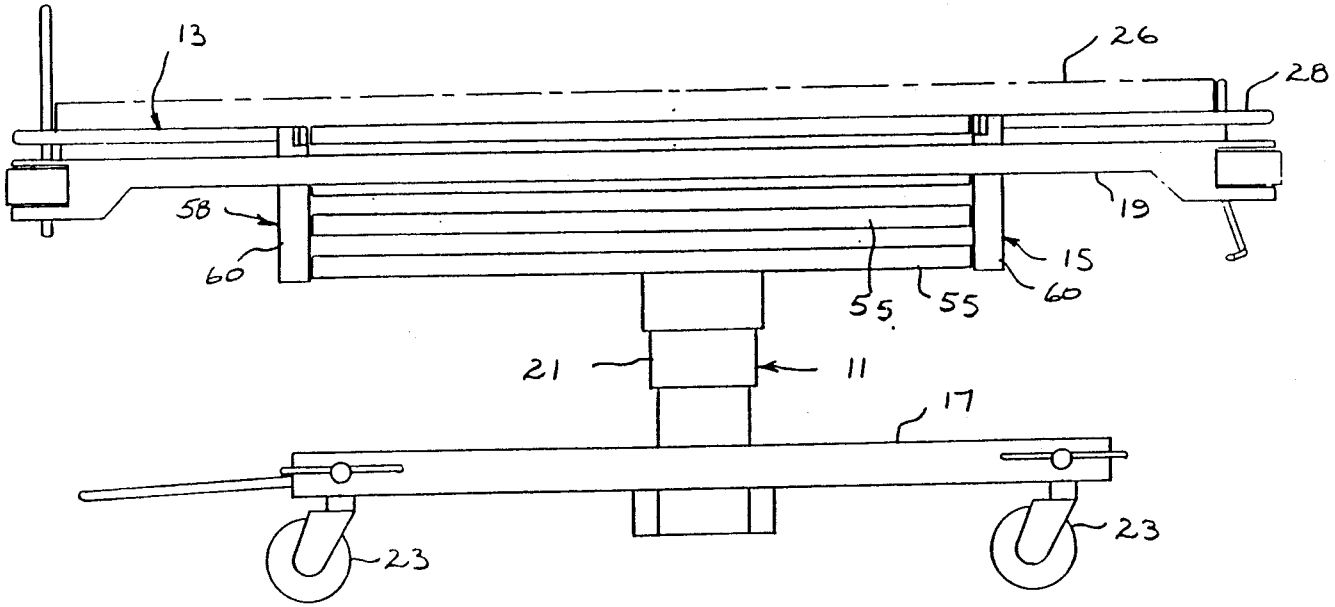
FIG. 1 is a side elevational view of a patient transfer trolley according to the embodiment, with the handling device on each longitudinal side of the trolley shown in the third (stored) position.

The embodiments shown in the drawings is directed to a patient transfer trolley which is used to convey patients to various locations in a hospital, as between a hospital ward and an operating theatre.

The trolley comprises a wheeled frame 11 which carries a patient supporting surface 13 and two patient handling devices 15 one adjacent each longitudinal side of the patient supporting surface 13.

The wheeled frame 11 comprises a lower frame section 17, an upper frame section 19 and a support post 21 the lower end of which is mounted on the lower frame section 17 and the upper end of which carries the upper frame section 19. The upper frame section is pivotal on the support post 21 so that the head and foot ends of the patient supporting surface 13 can be selectively raised and lowered. A locking mechanism (not shown) is provided to lock the upper frame section 19 in a selected position relative to the support post 21. The support post 21 is telescopic so that the level of the patient supporting surface 13 can be selectively varied. The lower frame section 17 is supported on castor wheels 23 in known manner.

The patient supporting surface 13 of the trolley includes a hinged portion 24 which can be tilted about hinge axis 25 in known manner to provide back support for a patient in an inclined position.

A mattress (as depicted by the phantom lines in the drawings and indicated by reference numeral 26) is normally positioned on the patient supporting surface 13. A hand rail 28 surrounds the patient support surface 13.

Figure 4:
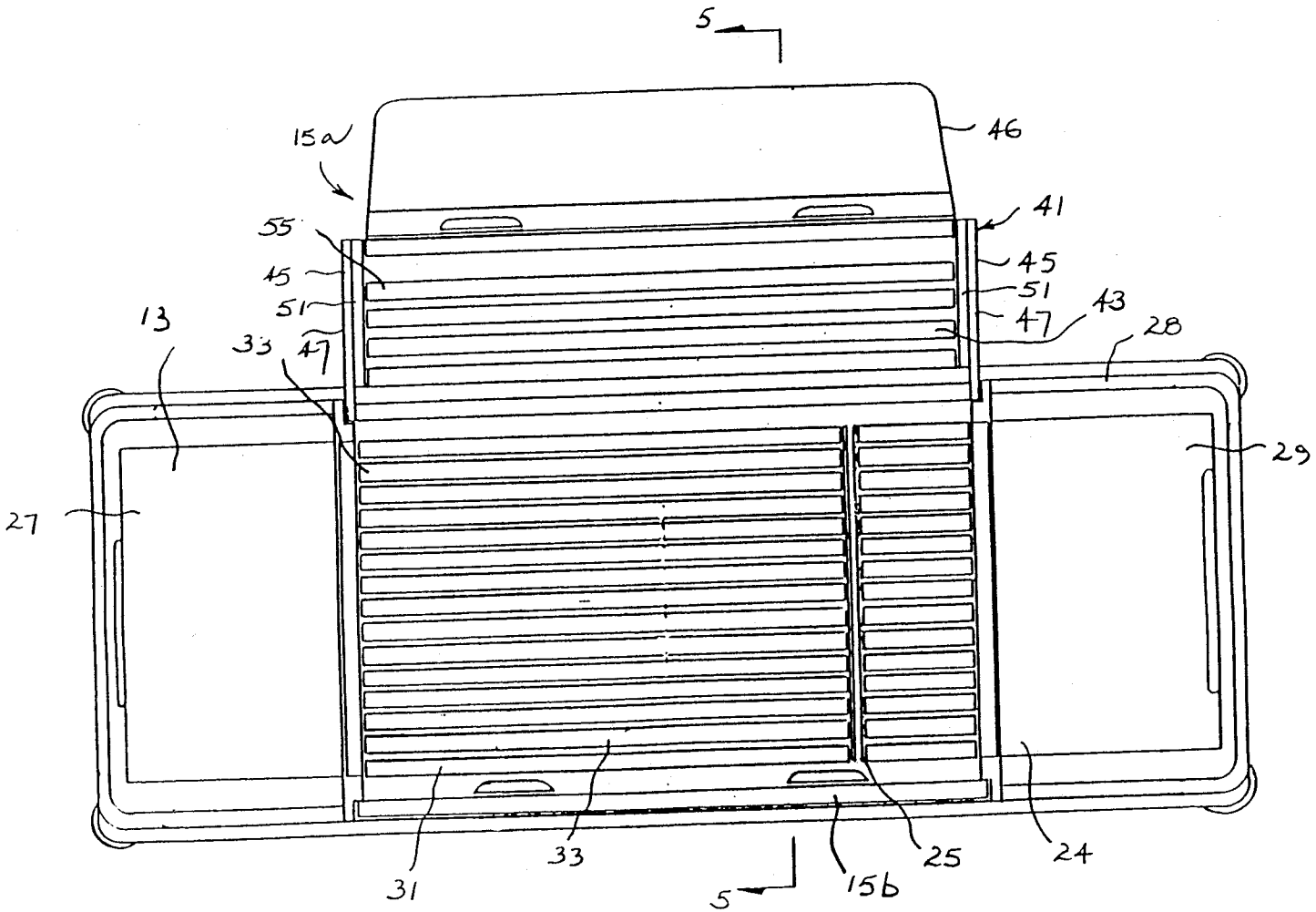
FIG. 4 is a plan view of the patient transfer trolley with the handling device on one side of the trolley shown in the first (bridging) position and the handling device on the other side of the trolley shown in the third (stored) position.

The patient supporting surface 13 includes a foot end section 27, a head end section 29 and an intermediate section 31 which corresponds to the location of the torso of a person lying on the patient supporting surface of the trolley. The intermediate section 31 is defined by a plurality of elongated rollers 33 disposed in the longitudinal direction of the patient supporting surface 13. The rollers 33 provide a surface over which a mattress 26 may be moved in a transverse direction, the purpose of which will become apparent later. The hinged portion 24 of the patient supporting surface 13 includes the head section 29 and part of the intermediate section 31, as best seen in FIG. 4 of the drawings.

Each handling device 15 comprises a body 41 having a transfer surface 43. The body 41 includes a first part 45 and second part 46 which is hingedly connected to the first part and provides an extension to the first part, as will become more apparent later.

The body 41 is of substantially the same length as the intermediate portion 31 of the patient supporting surface 13 and may assume any one of first, second and third positions.

Figure 5:
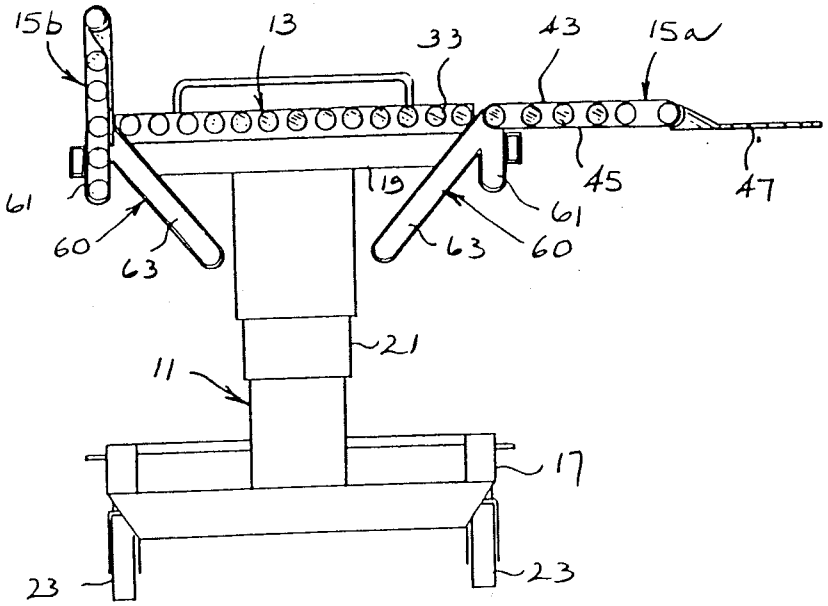
FIG. 5 is a section along the line 5-5 of FIG. 4 with the exception that the handling device on said other side is now shown in the second (upstanding) position.
Figure 7:
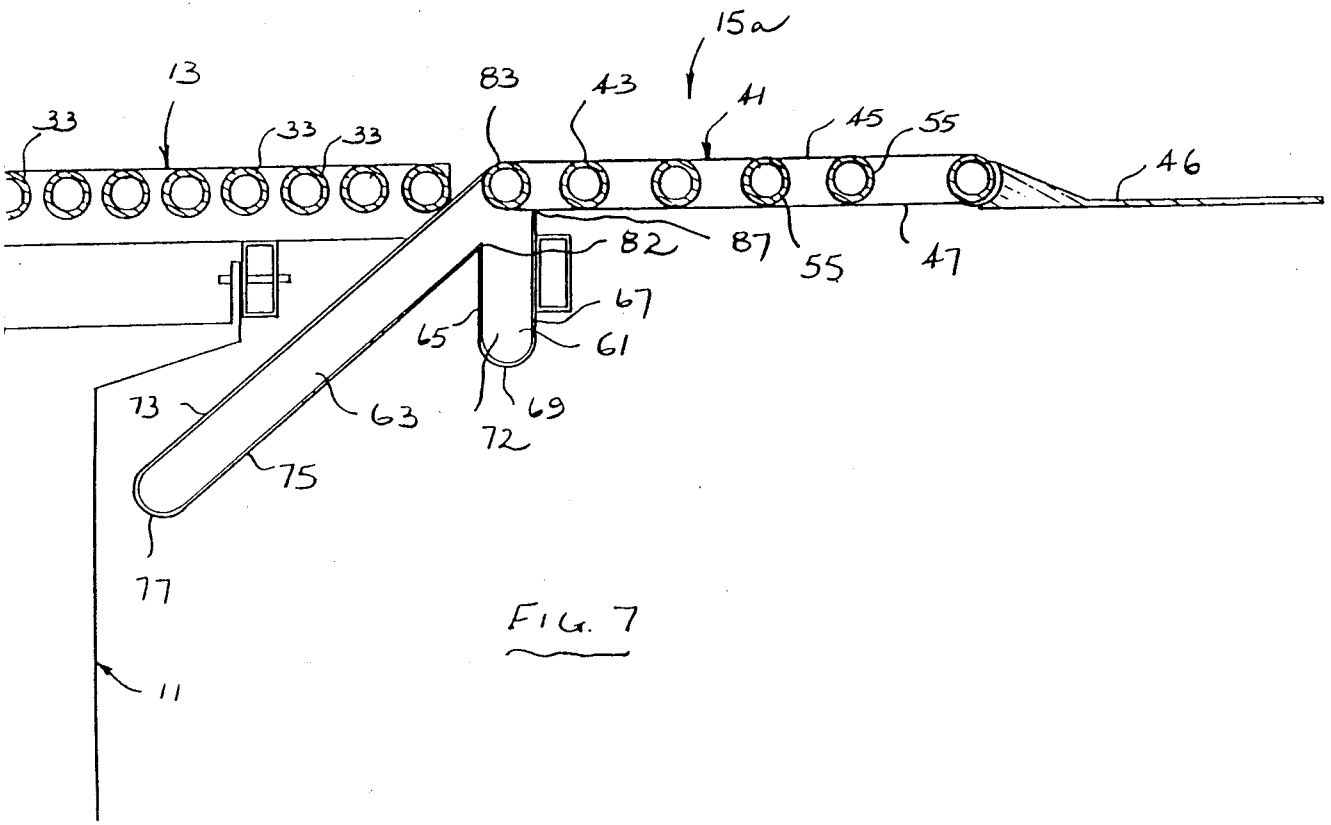
FIG. 7 is a fragmentary cross-sectional elevation (on an enlarged scale) showing one of the handling devices in the first (bridging) position.

In the first position, each handling device 15 is so positioned that the respective transfer surface 43 bridges the patient supporting surface 13 of the trolley and a further support surface located alongside the adjacent longitudinal side of the trolley, the further support surface may, for example, be a hospital bed, operating table or like supporting structure. In Figures 4, 5 and 7 of the accompanying drawings, the handling device 15a is shown in the first (bridging) position.

Figure 2:
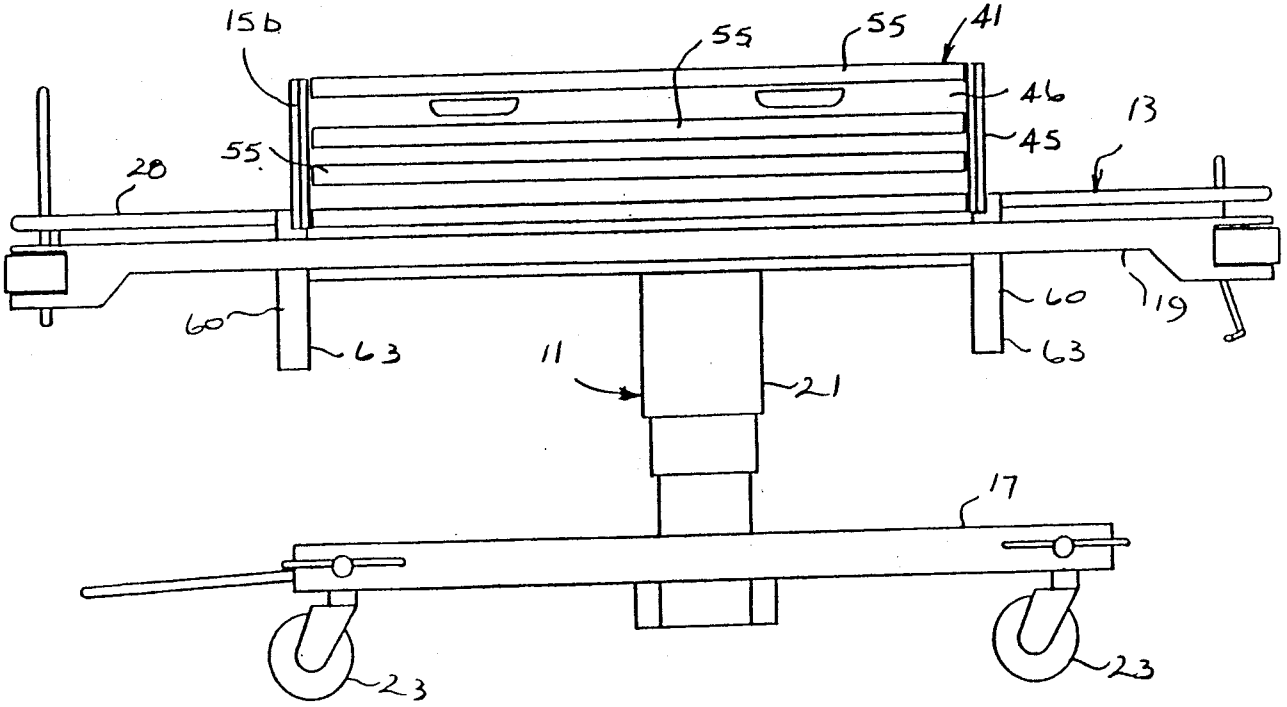
FIG. 2 is a view similar to FIG. 1, with the exception that the handling devices on both sides of the trolley are shown in the second (upstanding) position.
Figure 3:
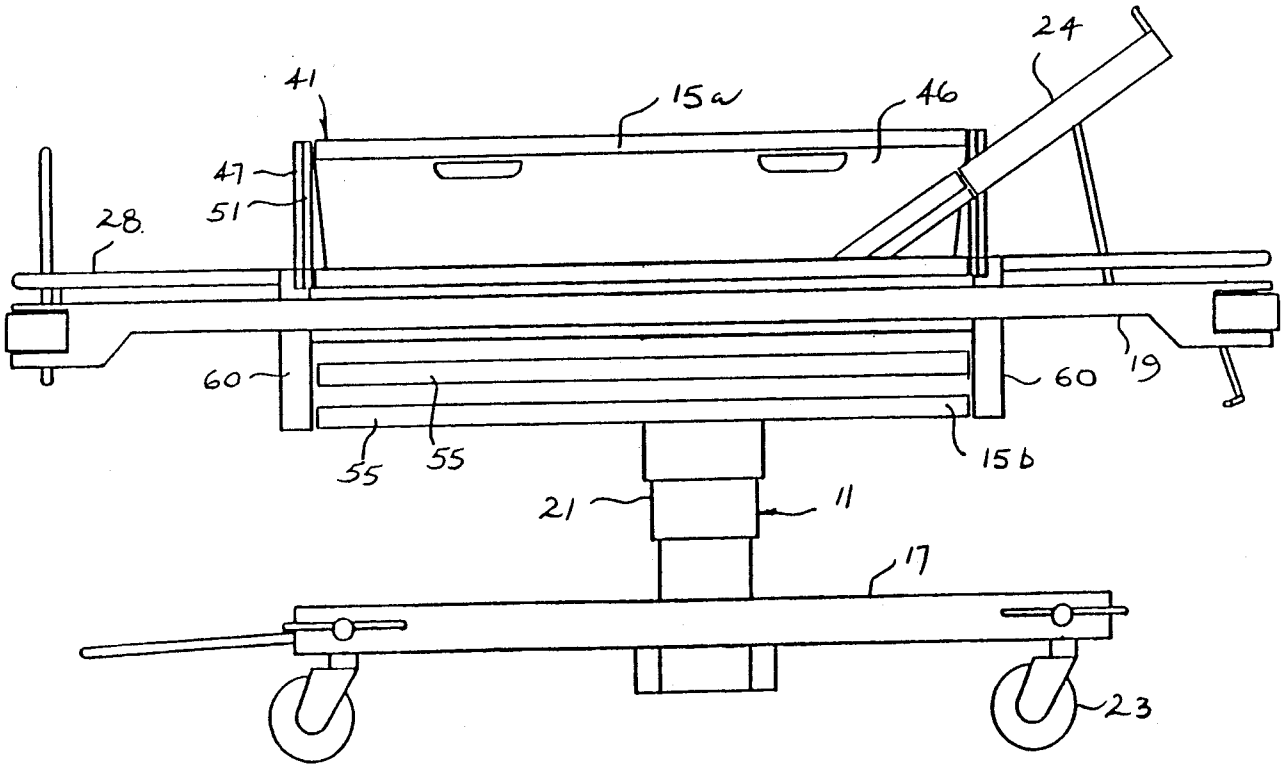
FIG. 3 is also a view similar to FIG. 1, with the exception that the handling device on the nearmost side of the trolley is shown in the third (stored) position and the handling device on the farmost side of the trolley is shown in the second (upstanding) position, and with the further exception that part of the patient supporting surface of the trolley is tilted to provide support for the back of a patient.
Figure 8:
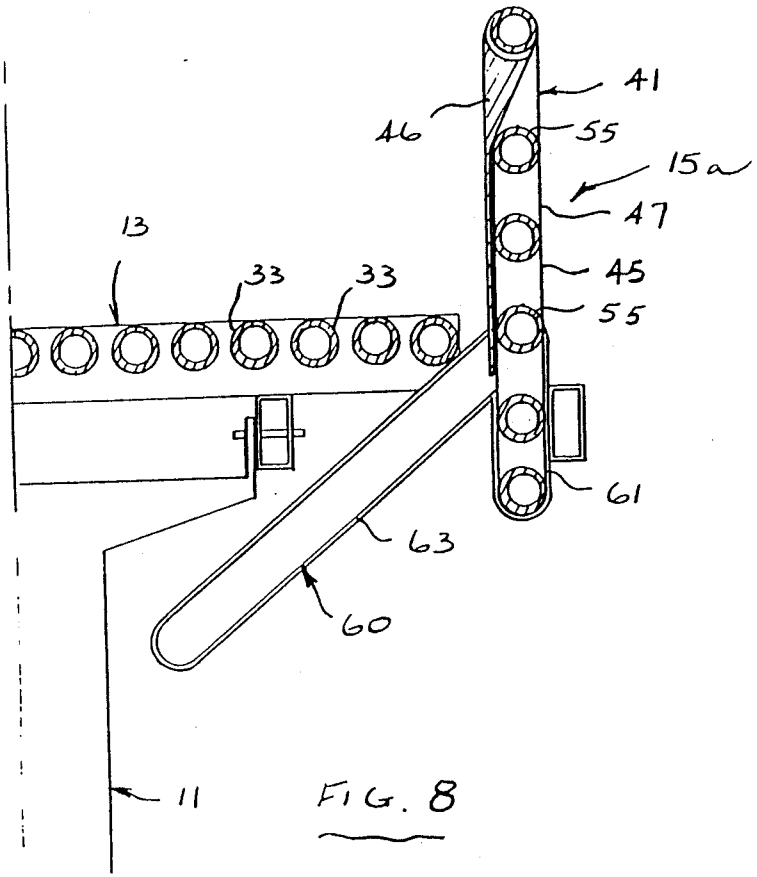
FIG. 8 is a view similar to FIG. 7 except that the handling device is shown in the second (upstanding) position.

In the second position, the body 41 extends upwardly alongside the patient supporting surface 13 of the trolley to thereby constitute a safety barrier which serves to prevent a patient from rolling sidewardly off the trolley. In FIGS. 2, 4 and 5 of the drawings, the handling device 15b is shown in the second (upstanding) position, and in FIG. 8 of the drawings the handling device 15a is shown in the second (upstanding) position.

Figure 6:
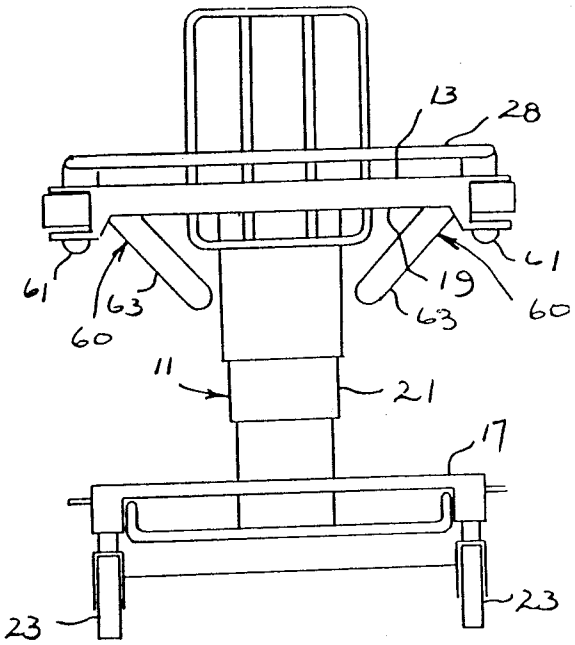
FIG. 6 is an end view of the patient transfer trolley, with each handling device shown in the third (stored) position.
Figure 9:
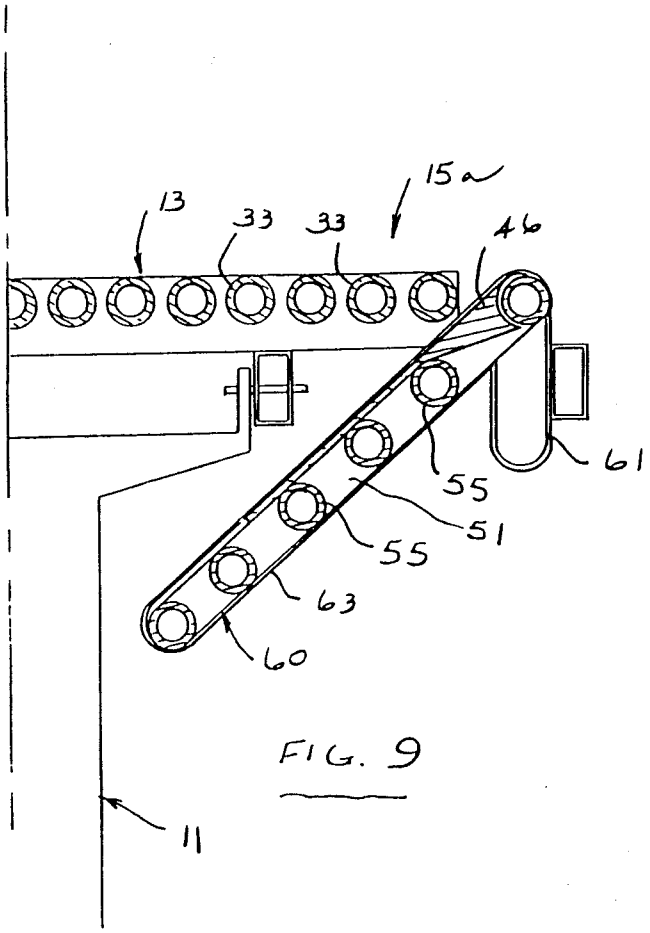
FIG. 9 is also a view similar to FIG. 7 except that the handling device is shown in the third (stored) position.

In the third position, each handling device is in a stored position so as to not impede access to the patient supporting surface 13 of the trolley. In this embodiment, the handling device is stored below the patient supporting surface 13 of the trolley when in such position, as best shown in FIG. 9 of the drawings. In addition to FIG. 9 of the drawings, the handling devices are shown in the third (stored) position in FIGS. 1 and 6 of the drawings.

The first part of the body 41 of each handling device 15 is mounted on track means 58 for movement between the first, second and third positions. The track means 58 includes a pair of spaced tracks 60 one at each end of the body 41, as will be more fully explained later.

The first part 45 of the body comprises a central section 42 mounted on a frame defined by a pair of elongated frame members 47. The inner end 50 of each member 47 is engaged with a respective one of the tracks 60 and the outer end 49 is hingedly connected at 51 to the central section 42 which is capable of limited hinging movement relative to the frame members 47, for a purpose which will become apparent later. A stop (not shown) prevents the central section from hinging downwardly beyond the frame members 47 when the handling device is in the first (bridging) position. The central section 42 comprises end members 53 between which are disposed a plurality of spaced rollers 55 extending longitudinally of the patient supporting surface 13 of the trolley. The first part 45 of the body 41 is so arranged that the rollers 55 provide a sideways extension to the intermediate portion 31 of the patient supporting surface 13 when the handling device is in the first (bridging) position.

As mentioned hereinbefore, each frame member 47 is engaged at its inner end with a respective one of the tracks 60. In this connection, the inner end of each frame member 47 is provided with a protrusion 57 which is slidably received and retained in the respective track 60.

Each track 60 includes a vertical track section 61 and an inclined track section 63 which extends downwardly and inwardly from the upper end of the vertical track section 61, as best shown in FIGS. 7, 8, 9 and 10 of the drawings. The vertical track section 61 includes spaced inner and outer side faces 65 and 67 respectively, a bottom face 69 and an outer end face 71, the inner end face 72 being open. Likewise, the inclined track section 63 includes spaced inner and outer side faces 73 and 75 respectively, a bottom face 77 and an outer end face 79, the inner end face 81 being open. The inner face 65 of the vertical track section 61 and the outer face 75 of the inclined track section 63 merge at 82. similarly, the outer face 67 of the vertical track section 61 and the inner face 73 of the inclined track section are interconnected through a transition face 83. A cut-out portion 85 is provided in the transition face 83 and the upper part of the outer face 67 of the vertical track section 61 through which cut-out portion 85 the frame member 47 and adjacent end member 53 extend when the handling device is in either the first or second position. The bottom edge 87 of the cut-out portion 85 provides an abutment against which frame end member 47 bears when the handling device is in the first (bridging) position, as best shown in FIG. 7 of the drawings. In such position, the protrusion 57 at the inner end of the frame member 47 bears on the underside of the transition surface 83 which extends between the outer face 67 of the vertical track section and the inner face 73 of the inclined track section.

When the handling device is in the third (stored) position each frame member 47 and the adjacent end member 53 is received in the respective inclined track section 63, as best shown in FIG. 9 of the drawings. In this way, the handling devices is stored below the patient supporting surface of the trolley.

In the second (upstanding) position the inner end of each frame member 47 and the adjacent end member 53 are received in the vertical track section 61 which effectively constitutes a socket to receive and support such members. In this way, the body is maintained in the upstanding position to provide a safety barrier alongside the patient supporting surface of the trolley.

Operation of the patient transfer trolley will now be described. To transfer a patient from a hospital bed onto the trolley, the trolley is positioned along side the hospital bed and the particular handling device 15 adjacent the hospital bed is moved into the first (bridging) position. The trolley is manoeuvred so as to position the outer end of the first part 45 on the support surface with the second part 46 of the body below a mat stretcher fabric or the like which has previously been positioned under the patient. An attendant standing on the opposite side of the trolley to the patient is able to grasp the mat and haul it sidewardly (with the patient thereon) over the rollers 55 and onto the patient supporting surface 13 of the trolley. With the patient positioned on the trolley, each handling device is moved into the second (upstanding) position so as to provide safety barriers serving to prevent the patient from rolling sidewardly off the trolley. The patient can then be conveyed to the desired location in the hospital at which location the trolley is positioned adjacent the supporting surface (such as an operating table) onto which the patient is to be positioned. The handling device adjacent the supporting surface is then moved into the first (bridging) position so as to bridge the space between the trolley and the support surface, with the outer end of the body 41 resting on the support surface. The attendant may then haul the patient on the mat sidewardly over the rollers 33 which form the intermediate section 31 of the patient supporting surface and the rollers 55 which form part of the transfer surfaces so as to position the patient on the operating table or other supporting surface.

Rather than utilizing a mat positioned beneath the patient to effect transfer between the trolley and another supporting surface, the mattress on which the patient is positioned may be moved with the patient if so desired.

Figure 10:
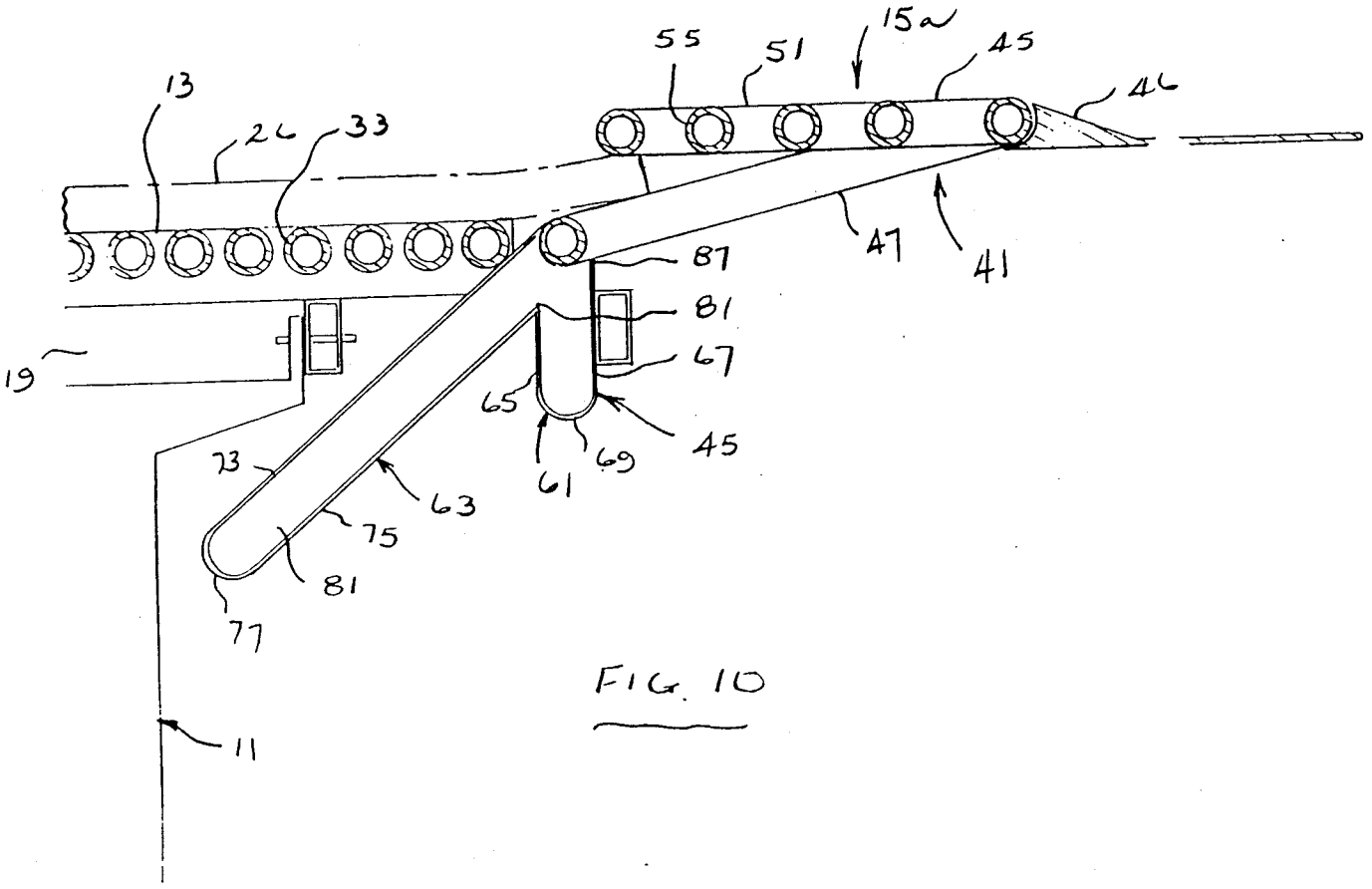
FIG. 10 is also a view similar to FIG. 7 except that the position of the handling device has been adjusted to facilitate transfer of a patient onto a mattress on the patient transfer trolley.
Figure 12:
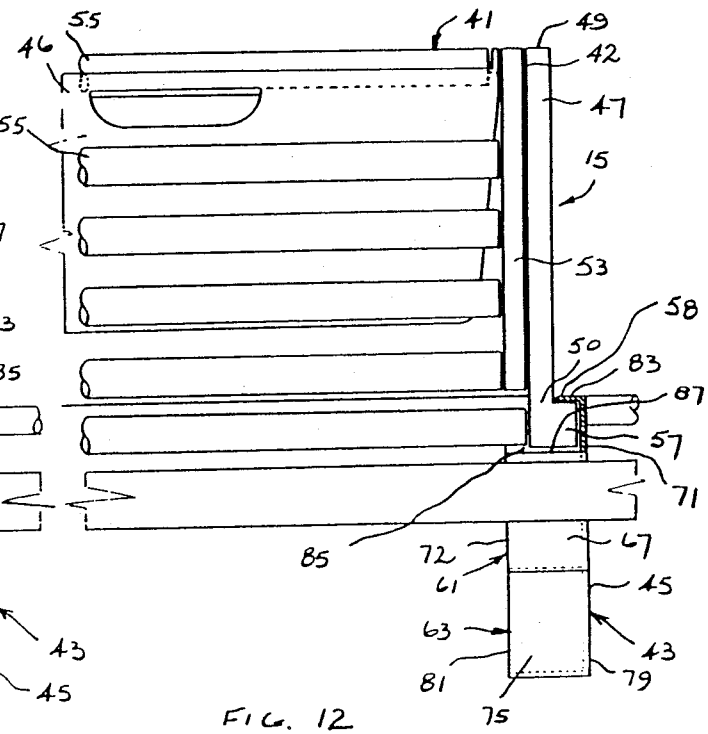
FIG. 12 is a view similar to FIG. 11, with the exception that the handling device is in readiness to assume any one of the first, second or third positions.
Figure 11:
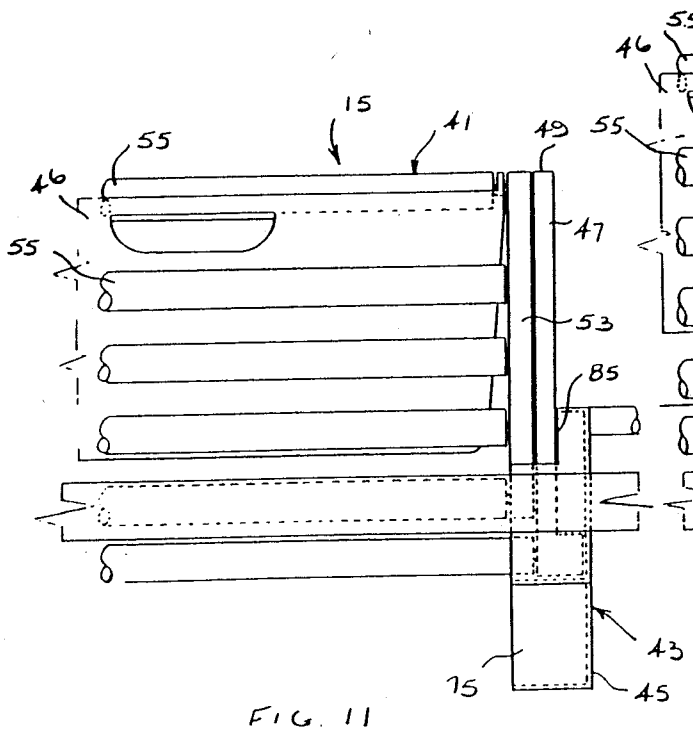
FIG. 11 is a fragmentary side elevational view showing one of the handling devices in the second (upstanding) position.

In circumstances where it is desired to move the patient from a support surface onto the mattress on the trolley, the central section 42 of the first part of the body may be tilted upwardly relative to the frame members 47 and the adjacent edge of the mattress positioned below the tilted central section 42 as shown in FIG. 10. In this way, the patient can be delivered directly onto the mattress of the trolley as he or she is hauled sidewardly towards the trolley. As the patient is moved across the transfer surface, the central section is urged downwardly thereby to clamp the mattress between the central section and the frame members. This serves to securely hold the mattress in position to receive the patient. The mattress can subsequently be returned to the central position and the trolley wheeled to the desired location.

From the foregoing, it is evident that a patient transfer trolley according to the invention enables a patient to be transferred between the hospital trolley and a further support surface (such as a hospital bed or an operating table) without the need for the patient to be manually lifted. This reduces the risk of injury to both hospital attendants and patients. In addition, it may well be that only one hospital attendant is required to perform the operation of transferring a patient from one location to another.

Although the invention has been described with reference to one specific embodiment, it is not limited thereto and various other alterations and modifications may be made without departing from the scope of the invention.

The claims defining the invention are as follows:

We claim:

1. A handling device for aiding patient transfer between two support surfaces when such surfaces are positioned adjacent one another, said handling device comprising a body having a transfer surface, attaching means interconnecting said body to an apparatus providing one of the support surfaces, said attaching means providing for pivotal and sliding movement of said body relative to said apparatus between first second and third positions, in the first position said transfer surface bridges said support surfaces, in the second position the body extends upwardly of said apparatus to provide a safety barrier therefor and in the third position said transfer surface extends in a downwardly inclined direction from a side of said apparatus to underlie its support surface.

2. A handling device for aiding patient transfer between two support surfaces as set forth in claim 1 wherein the body is connected by the attaching means at one side thereof to the apparatus for the pivotal and sliding movement and further including an elongated member pivotally connected to the other side of said body for movement between a retracted position lying adjacent said body and an extension position for providing an extension for said body for spanning the support surfaces.

3. A handling device for aiding patient transfer between two support surfaces as set forth in claim 1 further including roller means carried by said body for rotation about axes extending parallel to the support surfaces for facilitating transfer of the patient between said supporting surfaces.

4. A patient transfer trolley comprising a wheeled frame carrying a patient support surface and a device for aiding transfer of a patient between said patient support surface and a further support surface which in use is located adjacent said patient support surface, characterized in that the handling device comprises a body having a transfer surface, attachment means connecting said body to said frame for pivotal and sliding movement between first second and third positions, in the first position said transfer surface provides a bridge between said patient support surface and said further support surface, in said second position said body extends upwardly of the patient support surface to provide a safety barrier therefor and in said third position said body extends in a downwardly inclined position beneath said patient support surface.

5. A patient transfer trolley according to claim 4 wherein the attachment means comprises track means having a vertical track section and an inclined track section extending downwardly and inwardly from the upper end of the vertical track section wherein the body is received in and extends upwardly of the vertical track section when in the second position and wherein the body is received in the inclined track section when in the third position.

6. A patient transfer trolley according to claim 5 wherein the body includes a central section and the attachment means further comprises a pair of elongated frame members, the central section being pivotally connected to the frame members at one end thereof, the other end of the frame members being engaged with said track means.

7. A patient transfer trolley according to claim 6 wherein the central section includes a pair of end members between which elongated rollers are supported.

8. A patient transfer trolley according to claim 7 wherein each end member is disposed adjacent a respective one of the frame members on the inner side thereof and is pivotally connected adjacent its outer end to the respective frame member.

9. A patient transfer trolley according to claim 4 wherein at least part of the transfer surface is defined by a plurality of elongated rollers disposed longitudinally of the patient support surface.

10. A patient transfer trolley according to claim 9 wherein at least part of the patient support surface is defined by a plurality of further elongated rollers disposed longitudinally of the patient support surface.

11. A patient transfer trolley as set forth in claim 4 wherein the body is connected by the attaching means at one side thereof to the apparatus for the pivotal and sliding movement and further including an elongated member pivotally connected to the other side of said body for movement between a retracted position lying adjacent said body and an extension position for providing an extension for said body for spanning the support surfaces.

* * * * *